US011292111B2

(12) United States Patent
Rönblom et al.

(10) Patent No.: US 11,292,111 B2
(45) Date of Patent: Apr. 5, 2022

(54) ELECTRIC POWER TOOL FOR TIGHTENING SCREW JOINTS

(71) Applicant: ATLAS COPCO INDUSTRIAL TECHNIQUE AB, Stockholm (SE)

(72) Inventors: Johan Rönblom, Saltsjö-Boo (SE); Lisa Erika Larsson, Stockholm (SE); Göran Sivert Lantz, Hässelby (SE); Taru Johanna Nordström, Älta (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 0 days.

(21) Appl. No.: 17/050,480

(22) PCT Filed: Apr. 8, 2019

(86) PCT No.: PCT/EP2019/058744
§ 371 (c)(1),
(2) Date: Oct. 26, 2020

(87) PCT Pub. No.: WO2019/206609
PCT Pub. Date: Oct. 31, 2019

(65) Prior Publication Data

US 2021/0129301 A1 May 6, 2021

(30) Foreign Application Priority Data

Apr. 26, 2018 (SE) ..... 1830145-7

(51) Int. Cl.
*B25B 23/147* (2006.01)
*B25B 21/00* (2006.01)
*B25F 5/00* (2006.01)

(52) U.S. Cl.
CPC ..... *B25B 23/147* (2013.01); *B25B 21/001* (2013.01); *B25F 5/001* (2013.01)

(58) Field of Classification Search
CPC ..... B25B 23/147; B25B 21/001; B25F 5/001
(Continued)

(56) References Cited

U.S. PATENT DOCUMENTS 4,485,682 A 12/1984 Stroezel et al.
4,648,282 A 3/1987 Alender et al.
(Continued)

FOREIGN PATENT DOCUMENTS

EP 0092736 A1 11/1983
EP 0164574 A2 12/1985
(Continued)

OTHER PUBLICATIONS

International Preliminary Report on Patentability (IPRP) dated Sep. 17, 2020 issued in International Application No. PCT/EP2019/058744.
(Continued)

*Primary Examiner* — Michelle Lopez
(74) *Attorney, Agent, or Firm* — Holtz, Holtz & Volek PC

(57) ABSTRACT

An electric power tool for tightening screw joints includes a housing that encloses an electric motor, an angle gear, a back torque transducer, and a front torque transducer. The angle gear includes an input bevel gear drivingly connected to the electric motor and an output bevel gear drivingly connected to an output shaft of the electric power tool. The back torque transducer is arranged to measure a back torque reaction value before the input bevel gear. And the front torque transducer is arranged to measure a front torque reaction value after the output bevel gear.

14 Claims, 1 Drawing Sheet

(58) Field of Classification Search
USPC ..... 173/1, 176
See application file for complete search history.

(56) References Cited

U.S. PATENT DOCUMENTS

| | | | | |
|---|---|---|---|---|
| 8,302,702 | B2 * | 11/2012 | Hansson | B25B 21/00 173/182 |
| 2005/0150335 | A1 * | 7/2005 | Crane | B23P 19/066 81/467 |
| 2015/0122522 | A1 * | 5/2015 | Fujimoto | B25B 23/14 173/1 |
| 2016/0313198 | A1 | 10/2016 | Elsmark et al. | |
| 2018/0117746 | A1 | 5/2018 | Forsberg et al. | |

FOREIGN PATENT DOCUMENTS

| | | | |
|---|---|---|---|
| WO | 2015097093 | A1 | 7/2015 |
| WO | 2016156388 | A1 | 10/2016 |
| WO | 2019201589 | A1 | 10/2019 |

OTHER PUBLICATIONS

International Search Report (ISR) dated Jul. 12, 2019 issued in International Application No. PCT/EP2019/058744.
U.S. Appl. No. 17/044,277; First Named Inventor: Johan Rönblom; Title: "A Constant-Velocity Joint Assembly and a Power Tool Comprising the Same"; filed Sep. 30, 2020.
Written Opinion dated Jul. 12, 2019 issued in International Application No. PCT/EP2019/058744.

* cited by examiner

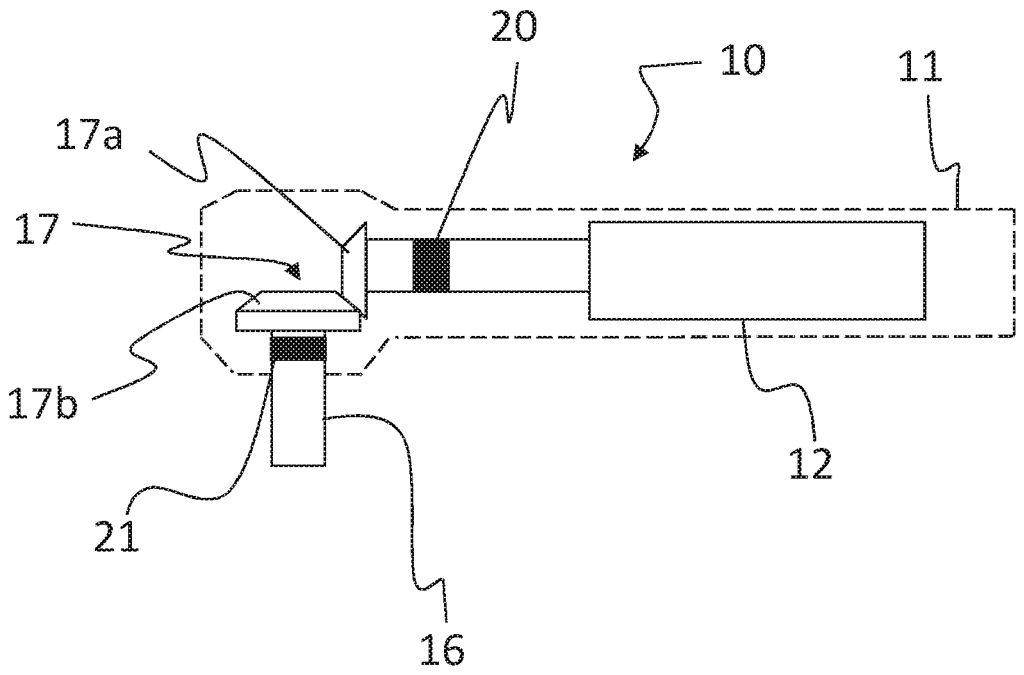
20
10
11
17a
17
17b
12
21
16

ELECTRIC POWER TOOL FOR TIGHTENING SCREW JOINTS

The present disclosure relates to an electric power tool for tightening screw joints. In particular to an electric power tool with increased accuracy.

BACKGROUND

In industrial use of torque delivering electric power tools such as power wrenches and nutrunners that are used for tightening joints it is important to monitor the applied torque in order to verify that the joints are fastened to a satisfactory degree. It is often desired to install a predetermined clamp force into a joint. Normally it is however difficult to monitor the clamp force and it is therefore common practice to instead control a tightening so as to install a specific target torque in a joint.

A difficulty related to the monitoring of a delivered torque is that there are losses due to friction in the joint and due to gear ripple and the like inside the tool that affects the accuracy of the monitoring values in an unpredictable manner. The friction in a joint may vary largely between different joints, but it may be presumed to be constant for a specific joint at specific conditions, and there are manners of estimating the friction for a specific joint, both by empiric testing or by real time monitoring during the tightening of a joint.

The variations that are due to gear ripple and the like inside the electric power tool are more difficult to predict. The variations that due to gear ripple also vary with the condition of the electric power tool. When the condition of the electric power tool is lowered the gear ripple of the electric power tool often increase.

Hence, there is a need of an improved electric power tool which is adapted to deliver a precise output torque and which is adapted to detect when the electric power tool need service.

SUMMARY OF THE INVENTION

An object of the invention is to provide an electric power tool for delivering a precise output torque with less variations due to gear ripple and the like. This object is achieved according to an exemplary embodiments of the present disclosure where the housing of the electric power tool encloses both a back torque transducer and a front torque transducer. The back torque transducer is provided on one side of the angle gear. And the front torque transducer is provided on the other side of the angel gear. By having two torque transducers, one on each side of the angel gear it is possible to get a more accurate torque result. This among others since the front torque transducer more accurately can measure the output torque on the output shaft.

Thus, a first aspect of the present disclosure relates to an electric power tool for tightening screw joints. The electric power tool comprises a housing. The housing encloses an electric motor and an angle gear comprising an input bevel gear drivingly connected to the electric motor and an output bevel gear drivingly connected to an output shaft of the electric power tool. The housing further encloses a back torque transducer arranged to measure a back torque reaction value before the input bevel gear. The electric power tool further comprise a front torque transducer arranged to measure a front torque reaction value after the output bevel gear.

Other features and advantages of the invention will be apparent from the figures and from the detailed description of the shown embodiment.

SHORT DESCRIPTION OF THE DRAWINGS

In the following detailed description reference is made to the accompanying drawings, of which:

FIG. 1 is a schematic view of an electric power tool 10 according to a specific embodiment of the invention.

DETAILED DESCRIPTION OF THE SHOWN EMBODIMENT OF THE INVENTION

In FIG. 1 an electric power tool 10 according to a specific embodiment of the invention is schematically shown. The electric power tool 10 comprises a housing 11. The housing 11 encloses an electric motor 12. The housing 11 further encloses an angle gear 17 comprising a input bevel gear 17*a* drivingly connected to the electric motor 12 and a output bevel gear 17*b* drivingly connected to an output shaft 16 of the electric power tool 10. The housing 11 yet further encloses a back torque transducer 20 arranged to measure a back torque reaction value before the input bevel gear 17*a*. Stated differently, in one embodiment, the back torque transducer 20 is arranged to measure the back torque reaction value between the motor 12 and the the input bevel gear 17*a*. Also enclosed by the housing 11 is a front torque transducer 21 arranged to measure a front torque reaction value after the output bevel gear 17*b*. Stated differently, in one embodiment, the front torque transducer 21 is arranged to measure the front torque reaction value that is transferred from the output bevel gear 17*b*.

A general idea according to exemplary embodiments of the present disclosure is to provide an electric power tool 10 were both the back torque transducer 20 and the front torque transducer 21 are enclosed in the housing 11. One advantage is that the electric power tool 10 can be made handheld since all the parts are encloses in the housing. Another advantage by having all the elements enclosed in that housing 11 is easier installation and logistics since all the parts are enclosed in the housing 11.

The back torque transducer 20 is provided on the back side of the angle gear 17. And the front torque transducer 21 is provided on the front side of the angel gear 17. By having two torque transducers 20, 21, one on each side of the angel gear 17, it is possible to get a more accurate torque result. This among others since the front torque transducer 21 more accurately can measure the output torque on the output shaft 16.

According to one exemplary embodiment of the present disclosure the electric power tool 10 is a hand held electric power tool 10. According to one exemplary embodiment the housing 11 of the electric power tool 10 is shaped to be ergonomic to hold for an operator. An advantage with this embodiment is that the electric power tool 10 becomes more ergonomic. The risk for injuries of the operator is thereby reduced.

In one exemplary embodiment of the present disclosure the front torque transducer 21 comprises a front torque transferring element (not shown) arranged to transfer reaction torque to the housing 11 and carrying front strain measuring sensors (not shown) arranged to generate a front torque transducer value.

In yet another exemplary embodiment of the present disclosure the back torque transducer 20 comprises a back torque transferring element (not shown) arranged to transfer back reaction torque to the housing 11 and carrying back strain measuring sensors (not shown) arranged to generate a back torque transducer value.

In one exemplary embodiment of the present disclosure the electric power tool 10 comprises a back amplifier arranged to amplify the back torque transducer value and arranged close to the back strain measuring sensors.

According to one exemplary embodiment of the present disclosure the electric power tool 10, further comprises a front amplifier arranged to amplify the front torque transducer value and arranged close to the front strain measuring sensors.

According to another exemplary embodiment of the present disclosure the electric power tool 10 is further operative to terminate a tightening when the front torque transducer value and the back torque transducer value exceeds a torque difference limit, where the torque difference limit is the difference between the front torque transducer value and the back torque transducer value.

In yet another exemplary embodiment of the present disclosure the electric power tool 10 is further operative to retrieve the torque difference limit.

The present disclosure further relates to an electric power tool controller (not shown) configured to control the electric power tool 10 according to any of the described exemplary embodiments.

In one exemplary embodiment of the present disclosure the electric power tool controller is operative to control a tightening performed by the electric power tool 10 based on the front torque transducer value or the back torque transducer value and monitor the tightening based on the front torque transducer value or the back torque transducer value not used to control the tightening.

According to another exemplary embodiment of the present disclosure the electric power tool controller is further operative to terminate a tightening when the front torque transducer value and the back torque transducer value exceeds a torque difference limit, where the torque difference limit is the difference between the front torque transducer value and the back torque transducer value.

In yet another exemplary embodiment of the present disclosure the electric power tool controller is further operative to retrieve the torque difference limit.

According to another exemplary embodiment of the present disclosure the electric power tool further comprises the electric power tool controller according to any of the described embodiments.

The present disclosure also relates to a computer readable storage medium comprising a computer program which when run in the electric power tool controller causes the electric power tool controller to be operative according to any of the described embodiments.

Above, the invention has been described with reference to specific embodiments. The invention is however not limited to these embodiments. It is obvious to a person skilled in the art that the invention comprises further embodiments within its scope of protection, which is defined by the following claims.

The invention claimed is:

1. An electric power tool for tightening screw joints, the electric power tool comprising a housing, and the housing enclosing at least:

an electric motor;

an angle gear comprising an input bevel gear drivingly connected to the electric motor and an output bevel gear drivingly connected to an output shaft of the electric power tool;

a back torque transducer configured to measure a back torque reaction value before the input bevel gear; and a front torque transducer configured to measure a front torque reaction value after the output bevel gear, wherein the front torque transducer comprises a front torque transferring element configured to transfer reaction torque to the housing and carrying front strain measuring sensors configured to generate the front torque transducer value and a front amplifier configured to amplify the front torque transducer value and arranged close to the front strain measuring sensors, and wherein the back torque transducer comprises a back torque transferring element configured to transfer back reaction torque to the housing and carrying back strain measuring sensors configured to generate the back torque transducer value.

2. The electric power tool according to claim 1, wherein the electric power tool is a hand held electric power tool.

3. The electric power tool according to claim 1, further comprising a back amplifier configured to amplify the back torque transducer value and arranged close to the back strain measuring sensors.

4. The electric power tool according to claim 1, further comprising a controller configured to control the electric power tool.

5. An electric power tool for tightening screw joints, the electric power tool comprising a housing, and the housing enclosing at least:

an electric motor;

an angle gear comprising an input bevel gear drivingly connected to the electric motor and an output bevel gear drivingly connected to an output shaft of the electric power tool;

a back torque transducer configured to measure a back torque reaction value before the input bevel gear; and a front torque transducer configured to measure a front torque reaction value after the output bevel gear, wherein the front torque transducer comprises a front torque transferring element configured to transfer reaction torque to the housing and carrying front strain measuring sensors configured to generate the front torque transducer value and a front amplifier configured to amplify the front torque transducer value and arranged close to the front strain measuring sensors, wherein the electric power tool further comprises a controller configured to control the electric power tool, and wherein the controller is configured to control the tightening performed by the electric power tool based on one of the front torque transducer value or the back torque transducer value and monitor the tightening based on the other of the front torque transducer value or the back torque transducer value not used to control the tightening.

6. The electric power tool according to claim 5, wherein the controller is further configured to terminate the tightening when the front torque transducer value and the back torque transducer value exceed a torque difference limit.

7. The electric power tool according to claim 6, wherein the controller is further configured to retrieve the torque difference limit.

8. An electric power tool for tightening screw joints, the electric power tool comprising a housing, and the housing enclosing at least:

an electric motor;

an angle gear comprising an input bevel gear drivingly connected to the electric motor and an output bevel gear drivingly connected to an output shaft of the electric power tool;

a back torque transducer configured to measure a back torque reaction value before the input bevel gear; and a front torque transducer configured to measure a front torque reaction value after the output bevel gear, wherein the front torque transducer comprises a front torque transferring element configured to transfer reaction torque to the housing and carrying front strain measuring sensors configured to generate the front torque transducer value and a front amplifier configured to amplify the front torque transducer value and arranged close to the front strain measuring sensors, wherein the electric power tool further comprises a controller configured to control the electric power tool, and wherein the controller is configured to terminate the tightening when the front torque transducer value and the back torque transducer value exceed a torque difference limit.

9. A non-transitory computer readable storage medium storing a computer program which is executable by a computer of an electric power tool for tightening screw joints, the electric power tool comprising a housing, and the housing enclosing at least (i) an electric motor, (ii) an angle gear comprising an input bevel gear drivingly connected to the electric motor and an output bevel gear drivingly connected to an output shaft of the electric power tool, (iii) a back torque transducer configured to measure a back torque reaction value before the input bevel gear, and (iv) a front torque transducer configured to measure a front torque reaction value after the output bevel gear, wherein the front torque transducer comprises a front torque transferring element configured to transfer reaction torque to the housing and carrying front strain measuring sensors configured to generate the front torque transducer value and a front amplifier configured to amplify the front torque transducer value and arranged close to the front strain measuring sensors, and wherein the computer program is executable by the computer to perform operations comprising:

controlling the tightening performed by the electric power tool based on one of the front torque transducer value or the back torque transducer value; and monitoring the tightening based on the other of the front torque transducer value or the back torque transducer value not used to control the tightening.

10. The non-transitory computer readable storage medium according to claim 9, the operations further comprising terminating the tightening when the front torque transducer value and the back torque transducer value exceed a torque difference limit.

11. The non-transitory computer readable storage medium according to claim 10, the operations further comprising retrieving the torque difference limit.

12. A controller for an electric power tool for tightening screw joints, the electric power tool comprising a housing, and the housing enclosing at least (i) an electric motor, (ii) an angle gear comprising an input bevel gear drivingly connected to the electric motor and an output bevel gear drivingly connected to an output shaft of the electric power tool, (iii) a back torque transducer configured to measure a back torque reaction value before the input bevel gear, and (iv) a front torque transducer configured to measure a front torque reaction value after the output bevel gear, wherein the front torque transducer comprises a front torque transferring element configured to transfer reaction torque to the housing and carrying front strain measuring sensors configured to generate the front torque transducer value and a front amplifier configured to amplify the front torque transducer value and arranged close to the front strain measuring sensors, and wherein the controller is configured to:

control the tightening performed by the electric power tool based on one of the front torque transducer value or the back torque transducer value; and monitor the tightening based on the other of the front torque transducer value or the back torque transducer value not used to control the tightening.

13. The controller according to claim 12, wherein the controller is further configured to terminate the tightening when the front torque transducer value and the back torque transducer value exceed a torque difference limit.

14. The controller according to claim 13, wherein the controller is further configured to retrieve the torque difference limit.

* * * * *